US009254041B2

(12) United States Patent
Kessler

(10) Patent No.: US 9,254,041 B2
(45) Date of Patent: Feb. 9, 2016

(54) FURNITURE FRAME, PARTICULARLY A CHAIR OR A TABLE FRAME, AND CHAIR OR TABLE FURNITURE CONTAINING SUCH A FURNITURE FRAME

(71) Applicant: VS VEREINIGTE SPEZIALMOEBELFABRIKEN GMBH & CO. KG, Tauberbischofsheim (DE)

(72) Inventor: Detlef Kessler, Tauberbischofsheim (DE)

(73) Assignee: VS Vereinigte Spezialmoebelfabriken GmbH & Co., KG, Tauberbischofsheim (DE)

( * ) Notice: Subject to any disclaimer, the term of this patent is extended or adjusted under 35 U.S.C. 154(b) by 0 days.

(21) Appl. No.: 14/629,962

(22) Filed: Feb. 24, 2015

(65) Prior Publication Data

US 2015/0238014 A1 Aug. 27, 2015

(30) Foreign Application Priority Data

Feb. 24, 2014 (EP) ..... 14156346

(51) Int. Cl.
*A47C 7/50* (2006.01)
*A47C 7/00* (2006.01)
*A47B 13/02* (2006.01)

(52) U.S. Cl.
CPC ..... *A47C 7/004* (2013.01); *A47B 13/02* (2013.01); *A47C 7/50* (2013.01); *A47C 7/506* (2013.01)

(58) Field of Classification Search
CPC ..... A47C 7/004; A47C 7/506; A47C 7/50; A47B 13/02; A47B 2200/0097
USPC ..... 297/423.25, 423.38, 423.1, 344.18; 248/405, 406.1, 408, 409, 415, 416, 248/423, 188.4, 188.8; 108/147.19, 147.2
See application file for complete search history.

(56) References Cited

U.S. PATENT DOCUMENTS

| | | | | |
|---|---|---|---|---|
| 1,723,363 A | | 8/1929 | McArdle | |
| 2,987,110 A | * | 6/1961 | Cramer, Jr. | 248/406.1 |
| 4,348,051 A | | 9/1982 | Boucher | |

(Continued)

FOREIGN PATENT DOCUMENTS

| | | |
|---|---|---|
| DE | 1282882 B | 11/1968 |
| DE | 102006011491 B3 | 10/2007 |

(Continued)

*Primary Examiner* — Milton Nelson, Jr.
(74) *Attorney, Agent, or Firm* — Laurence A. Greenberg; Werner H. Stemer; Ralph E. Locher

(57) ABSTRACT

A furniture frame contains a support column, a furniture leg to support the support column, a foot ring, and a fastening device affixing the foot ring to the support column. The fastening device contains a first threaded bushing being non-rotatably connected to the support column and has an external thread, and a second threaded bushing being non-rotatably connected to the foot ring and has an internal thread. The internal thread engages with the external thread. The second threaded bushing is rotatable about the first threaded bushing by at least one revolution such that the second threaded bushing can be axially moved relative to the first threaded bushing. The fastening device has as a locking element which prevents a relative movement between the first and the second threaded bushing in a first operating position and enables relative movement between the first and the second threaded bushing in a second operating position.

14 Claims, 12 Drawing Sheets

(56) References Cited

U.S. PATENT DOCUMENTS

| | | | | |
|---|---|---|---|---|
| 4,623,195 | A * | 11/1986 | Avella | 297/423.38 |
| 7,306,192 | B2 | 12/2007 | Sopp | |
| 8,517,472 | B1 * | 8/2013 | Proctor | 297/423.1 |
| 2006/0175518 | A1 | 8/2006 | Hu | |
| 2011/0226925 | A1 * | 9/2011 | Tsai | 248/411 |
| 2014/0070592 | A1 * | 3/2014 | Yeh | 297/423.38 |
| 2014/0265512 | A1 * | 9/2014 | Pritchard | 297/423.38 |

FOREIGN PATENT DOCUMENTS

| | | | |
|---|---|---|---|
| JP | 2002320531 | A | 11/2002 |
| TW | M262104 | U | 4/2005 |

* cited by examiner

FURNITURE FRAME, PARTICULARLY A CHAIR OR A TABLE FRAME, AND CHAIR OR TABLE FURNITURE CONTAINING SUCH A FURNITURE FRAME

CROSS-REFERENCE TO RELATED APPLICATION

This application claims the priority, under 35 U.S.C. §119, of European application EP 14 156 346.0, filed Feb. 24, 2014; the prior application is herewith incorporated by reference in its entirety.

BACKGROUND OF THE INVENTION

Field of the Invention

The invention relates to a furniture frame, particularly a chair or a table frame, containing a support column and a foot ring attached thereto as well as a chair or a table containing such a chair or table frame.

Conventional swivel chairs have a centric, substantially vertically extending, possibly length-adjustable, support column having a longitudinal axis which is mounted on a pedestal (base) and supports a seat with (or without) a backrest. To increase user comfort with such swivel chairs, it is known to provide a foot ring above the base on which the user seated in the seat can place one or both feet. The foot ring can also be termed a step aid, foot support ring or footrest.

Thus, published, non-prosecuted German patent application DE 12 82 882 A for example discloses a swivel chair having a supporting shaft and a cross-base, whereby a foot ring is provided directly and thereby at a fixed predefined height on the cross-base.

German patent DE 10 2006 011 491 B3, corresponding to U.S. Pat. No. 7,306,192, proposes to affix a foot ring to a height-adjustable chair column. The foot ring is thereby attached to the end of a guide tube projecting from the vertical post using a stepped bore so that adjusting the height of the chair column simultaneously adjusts the height of the foot ring correspondingly.

There is additionally the need for a foot ring affixed to a support column to also be vertically adjustable, whereby the vertical adjustment of the foot ring occurs independently of an applicable height adjustment to the support column so that the furniture (particularly seating furniture or table furniture) can be better adapted to a user's personal needs and comfort preferences.

Such a chair frame is disclosed for example in Japanese patent application JP 2002-320531 A. This conventional chair frame contains a first threaded bushing having an external thread and arranged at the support column and a second threaded bushing having an internal thread and arranged at the foot ring, wherein the internal thread of the second threaded bushing engages with the external thread of the first threaded bushing and wherein the second threaded bushing is rotatable about the first threaded bushing so as to axially move the second threaded bushing and the foot ring relative to the first threaded bushing and the support column. For fixing the foot ring in a desired height position there is provided a screw element which is positioned at the second threaded bushing at the foot ring and which can be jammed with the first threaded bushing at the support column.

SUMMARY OF THE INVENTION

It is an object of the present invention to provide an improved furniture frame having a foot ring. The furniture frame of the invention is to in particular enable a user-friendly vertical adjustment of the foot ring on the support column of the furniture frame.

The furniture frame of the invention contains a support column having a longitudinal axis, a foot ring and a fastening device with which the foot ring is affixed to the support column so as to be axially displaceable. The fastening device contains a first threaded bushing arranged coaxially with the support column, non-rotatably connected to the support column and having an external thread, as well as a second threaded bushing arranged coaxially with the support column, non-rotatably connected to the foot ring and having an internal thread. The internal thread of the second threaded bushing engages with the external thread of the first threaded bushing and the second threaded bushing is rotatable about the first threaded bushing by at least one revolution such that the second threaded bushing can be axially moved relative to the first threaded bushing. In addition, the fastening device contains a locking element which is movable between a first operating position and a second operating position, wherein the locking element prevents relative movement between the first threaded bushing and the second threaded bushing in the first operating position and enables relative movement between the first threaded bushing and the second threaded bushing in the second operating position. Further, the first threaded bushing exhibits a first longitudinal groove on its exterior, the locking element engages in the first longitudinal groove in its first operating position, and the locking element is preloaded into its first operating position.

By the special design of the fastening device with the first and second threaded bushing, the foot ring can for example be freely positioned on the support column by the user of the furniture frame and thus optimally adjusted to the user's needs. Thus, even in the case of a length-adjustable support column, the foot ring is vertically positioned independently of the adjustment to the support column itself.

The engagement of a first threaded bushing non-rotatably connected to the support column and a second threaded bushing non-rotatably connected to the foot ring enables the foot ring to be axially adjusted by a simple rotational movement about the longitudinal axis of the support column. The furniture frame of the invention thus has a very user-friendly positioning option for the foot ring attached to the support column. The second threaded bushing is thereby rotatable about the first threaded bushing by at least one revolution, preferably by a plurality (i.e. two, three, four or more) of revolutions. The number of possible revolutions is thereby a function of the number of adjustable usage positions at different heights and the maximum axial displacement rate, or defines these variables respectively. In conjunction hereto, a revolution refers to one full 360° rotation.

A foot ring in the present context is to be understood as a furniture element on which a user of the furniture can set or support his or her feet. The foot ring can also be termed, for example, a step aid, footrest or foot support ring. Despite the name foot ring, it is not necessarily of circular design and does not necessarily extend circumferentially around the entire support column. The foot ring can thus also optionally extend as a ring only across one or more sectors or secants and/or be curved, have one or multiple angles or a substantially straight form.

The locking element lets the user easily—depending on the operating position of the locking element—inhibit or enable the vertical adjustment of the foot ring on the support column. The locking element thus also contributes to the user-friendliness of the furniture frame of the invention.

According to the invention, the first threaded bushing exhibits a first longitudinal groove on its exterior in which the locking element engages in its first operating position. The locking element engaging in the first longitudinal groove of the first threaded bushing preferably can inhibit a rotational movement of the second threaded bushing (and the foot ring), in which the locking element is preferably held non-rotatably, around the first threaded bushing (and the support column). In this way, the locking mechanism can be configured invisible for a user. In addition, the height adjustment of the foot ring can take place user-friendly and without big effort.

The first longitudinal groove is configured on the exterior of the first threaded bushing and preferably extends substantially parallel to the longitudinal axis of the support column. The first longitudinal groove preferably repeatedly crosses the helical circumferential thread groove of the first threaded bushing's external thread.

Furthermore, according to the invention, the locking element is preloaded in its first operating position. The configuration can preferably prevent an inadvertent displacing of the foot ring's vertical position, for example upon the foot ring being subjected to a load. To achieve the preloading, the locking element is preferably operatively connected to a spring element. In addition, this pre-load of the locking element into its first operating position can achieve an automatic locking of the second threaded bushing and the foot ring in a desired height position. Thus, the height adjustment of the foot ring can take place user-friendly and without big effort.

It is preferable for the furniture frame to have exactly one support column. The support column is preferably arranged and mounted substantially centrically on a furniture leg. The rotatability of the foot ring relative to the support column is achieved in the inventive furniture frame by the first and the second threaded bushing such that the support column can in principle have any cross-sectional shape; it is preferably of substantially circular, square or rectangular design in cross section. The support column can be of substantially solid or at least partly hollow design. The support column is preferably manufactured from a metallic material or a high-strength plastic material.

The support column of the furniture frame can have a fixed length or can be adjustable in length. A length-adjustable support column preferably exhibits a pneumatic spring containing a cylinder and a piston rod. In the case of a length-adjustable support column, the foot ring is preferably attached in the fixed part area of the support column (e.g. cylinder of the pneumatic spring) so as to be axially displaceable.

The longitudinal axis of the support column preferably extends substantially vertically (relative to the substantially horizontal floor space on which the furniture frame stands). The axial direction in this context denotes a direction substantially colinear or parallel to the longitudinal axis of the support column, and the radial direction in this context denotes a direction substantially perpendicular to the longitudinal axis of the support column.

The threaded bushings in each case preferably have a substantially tubular basic form. They are arranged coaxially with the support column; i.e. their longitudinal axes coincide with the longitudinal axis of the support column. The first threaded bushing thereby preferably has a substantially (circular) shaped outer circumference and the second threaded bushing preferably has a substantially (circular) shaped inner circumference. The exterior of the first threaded bushing has an external thread and the interior of the first threaded bushing is non-rotatably connected to the exterior of the support column. The interior of the second threaded bushing has an internal thread and the exterior of the second threaded bushing is preferably non-rotatably connected to the interior of the hub of the foot ring. The hub is preferably integrally formed with the foot ring or non-rotatably connected to same. The second threaded bushing is preferably arranged substantially coaxially with the first threaded bushing. The second threaded bushing preferably encloses the first threaded bushing substantially completely. The (first and/or second) threaded bushing is preferably of circumferential and/or axial one-piece or multi-part design. The first threaded bushing preferably extends axially over most of the length of the support column or the fixed part of the length-adjustable support column respectively. The second threaded bushing is preferably axially shorter than the first threaded bushing. The threaded bushings are preferably manufactured from a plastic material.

The external thread of the first threaded bushing and/or the internal thread of the second threaded bushing are preferably configured as trapezoidal threads, particularly preferentially as double-start trapezoidal thread. This configuration preferably achieves the advantage that the forces from mechanical load on the foot ring (particularly including unilateral or asymmetrical load) can be transferred to the (stable) support column by the threads of the threaded bushings.

A non-rotatable connection or arrangement between two components refers to a design in which the two components cannot rotate relative to each other without destruction. The non-rotatable arrangement is preferably configured as a form-fit, force-fit and/or materially bonded connection between the components. Such a connection is preferably achieved by at least one of the two components having a cross-sectional profile deviating from the circular (e.g. by means of knurled or welded steel plates), by gluing or welding the two components, by a press fit between the two components, by shrink fitting one component onto the other component (e.g. during the cooling subsequent forming of the one component), by an integral design of the two components together or by combinations of the above measures or the like.

The locking element is an apparatus suited to and arranged between a first operating position and a second operating position to preferably move back and forth multiple times. The locking element is thereby in contact or engagement with the first threaded bushing and with the second threaded bushing, at least in one of each of the two operating positions. The locking element is preferably of one-piece or multi-part design. The locking element is preferably made from metal or plastic.

The furniture frame is particularly suitable for seating furniture and table furniture, particularly preferentially for chairs, swivel chairs and standing tables. The furniture frame preferably exhibits a leg to support the support column. The furniture leg is basically any stand device for the furniture frame and/or the furniture as a whole, it can selectively be configured as a movable furniture leg (e.g. with castors) or as a stationary furniture leg.

In a preferred configuration of the invention, the fastening device further contains an actuating element which is operatively connected to the locking element so as to be able to move the locking element between its first and second operating position. The actuating element is preferably disposed so as to be freely accessible and able to be operated by the user of the furniture frame. Preferably, the actuating element is provided and/or disposed on/in the foot ring or provided and/or disposed in a retaining element on the foot ring. When the locking element is to be preloaded into its first operating position, the actuating element preferably contains a spring element for this purpose.

In a further preferred configuration of the invention, the locking element is non-rotatably disposed relative to the second threaded bushing and radially movable relative to the first threaded bushing.

In a preferred configuration of the invention, the locking element exhibits a clamping block, or is configured as a clamping block respectively, which engages in the first longitudinal groove of the first threaded bushing in the first operating position of the locking element. The clamping block engaging in the first longitudinal groove of the first threaded bushing can preferably hinder a rotational movement of the second threaded bushing (and thus the furniture element), in which the locking element is preferably non-rotatably disposed, about the first threaded bushing (and thus about the support column).

In a preferred configuration of the invention, the locking element contains a mandrel which engages with the external thread of the first threaded bushing in the second operating position of the locking element.

In a further preferred configuration of the invention, a plurality of axial recesses are formed in the first longitudinal groove and the locking element contains a clamping block (or is configured like a clamping block respectively), which engages in the first longitudinal groove of the first threaded bushing in the locking element's first operating position, and a mandrel which engages in one of the recesses in the first longitudinal groove of the first threaded bushing in the locking element's first operating position and engages in the external thread of the first threaded bushing in the locking element's second operating position.

The above-cited preferred configurations can achieve at least one of the advantages of the locking element remaining in a desired position relative to the two threaded bushings during the relative rotational motion between the first and the second threaded bushing and of the foot ring remaining more securely in the adjusted vertical position in the first operating position of the locking element.

The first longitudinal groove is preferably spaced at a distance from the end of the first threaded bushing facing toward the furniture leg and/or from the end of the first threaded bushing facing away from the furniture leg. Such spacings enable limit stops to be readily provided for the axial up and down movement of the second threaded bushing relative to the first threaded bushing.

The width of the locking element's clamping block in the circumferential direction of the first threaded bushing is preferably dimensioned somewhat smaller than the width of the first longitudinal groove. The most precise possible fitting of the clamping block in the longitudinal groove—together with the mandrel engaging into a longitudinal groove recess if needed—can affect the greatest possible zero-play retaining of the foot ring at the desired vertical position on the support column.

The clamping block of the locking element is preferably of larger dimension in the axial direction than a width of the thread groove of the first threaded bushing's external thread. It is particularly preferential for the clamping block of the locking element to be axially dimensioned at least as large as a pitch of the first threaded bushing's external thread.

The recesses in the first longitudinal groove of the first threaded bushing are in each case preferably arranged within the progression of the thread groove of the first threaded bushing's external thread. Preferentially, the recesses are provided in the first longitudinal groove at each pass of the thread groove or only at each second or each third pass of the thread groove through the first longitudinal groove.

In a further preferred configuration of the invention, a safety device is provided on the first threaded bushing and/or the second threaded bushing which prevents a movement of the second threaded bushing beyond the end of the first threaded bushing facing away from the furniture leg. This locking effect is to also be provided particularly for the locking element in its second operating position. The safety device preferably comprises a securing ring inserted into an annular groove at the upper end of the support column.

In yet a further preferred configuration of the invention, the first threaded bushing contains at least one second longitudinal groove with which the locking element cannot engage. This at least one second longitudinal groove can automatically eliminate material abrasion of the threaded bushings and the locking element (occurring due to relative movements of engaged components) from the furniture frame. In one embodiment, the mandrel of the locking element in its second operating position conveys material abrasion along the thread groove of the external thread of the first threaded bushing to the at least one second longitudinal groove of the first threaded bushing through which it can then drop. In the case of exactly one second longitudinal groove, it is preferably disposed substantially diametrically opposite to the first longitudinal groove.

According to a further aspect of the present invention, a chair contains a seat and a chair frame of the invention as described above, whereby the support column of the chair frame supports the seat, either directly or by a seat support in-between. All of the advantages, definitions of terms and preferential further developments specified above in conjunction with the furniture frame also apply analogously to the chair furniture.

According to a further aspect of the present invention, a table contains a table top and a table frame of the invention as described above, whereby the support column of the table frame supports the table top, either directly or by a table top support in-between. All of the advantages, definitions of terms and preferential further developments specified above in conjunction with the furniture frame also apply analogously to the table furniture.

Lastly, the present invention is also directed a foot ring for a furniture frame of the invention as described above.

Other features which are considered as characteristic for the invention are set forth in the appended claims.

Although the invention is illustrated and described herein as embodied in a furniture frame, particularly a chair or a table frame, and chair or table furniture containing such a furniture frame, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF A PREFERRED EMBODIMENT

Figure 1:
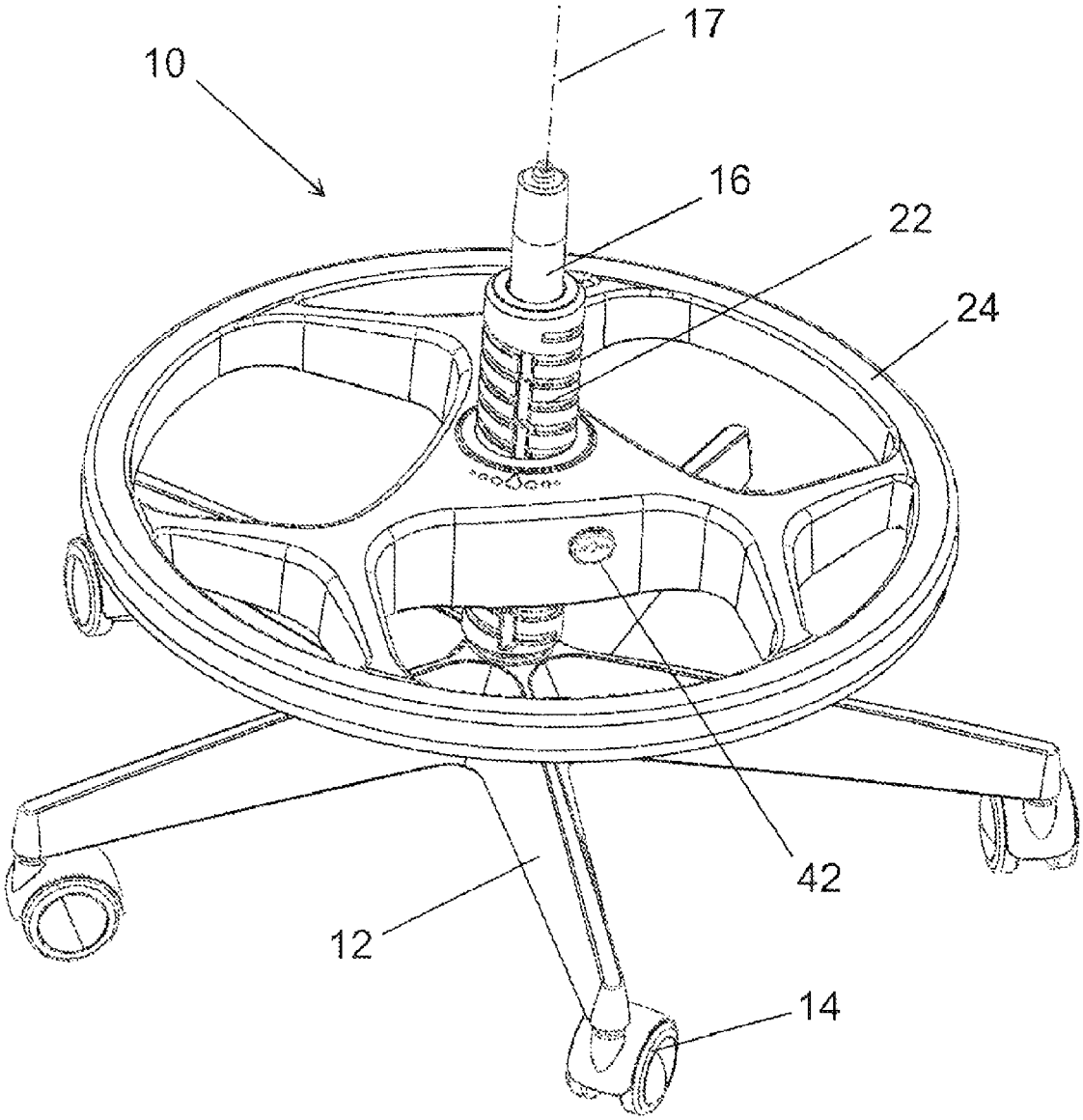
FIG. 1 is a diagrammatic, perspective view of a chair frame according to one embodiment of the invention.
Figure 2:
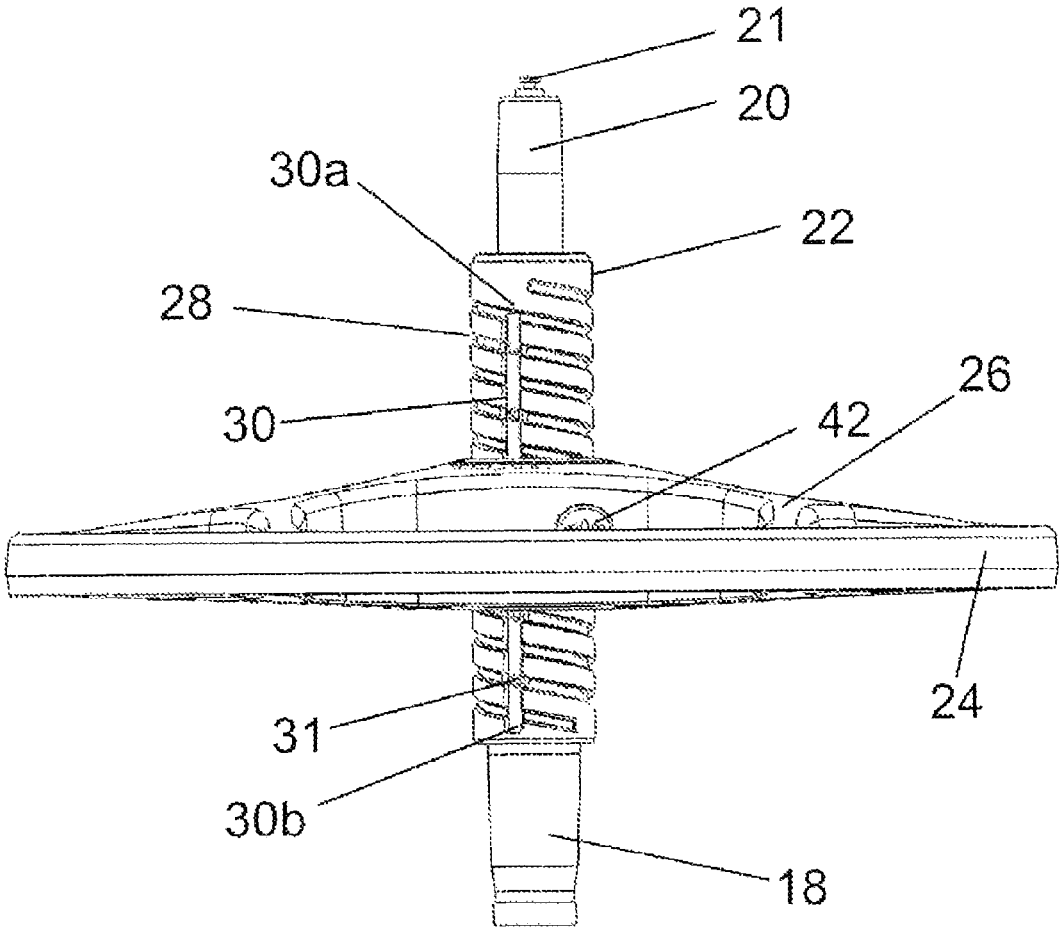
FIG. 2 is a side view of the chair frame of FIG. 1 without a star base.
Figure 3:
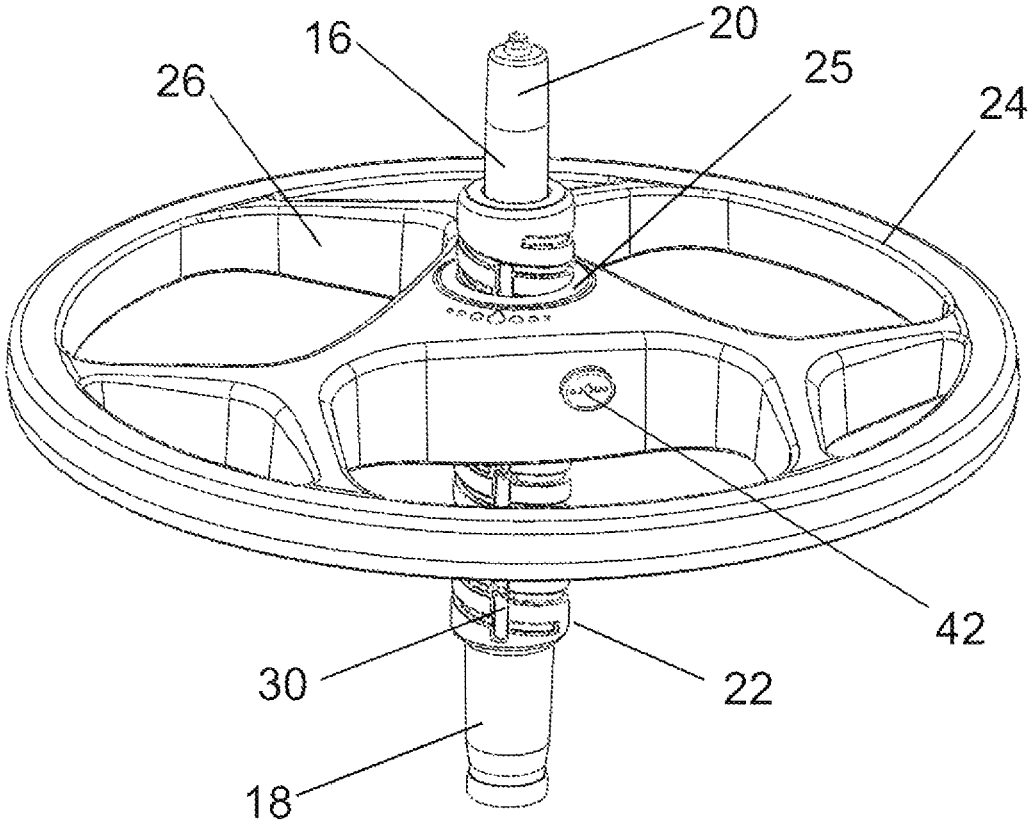
FIG. 3 is a perspective view of the chair frame of FIG. 1 without a star base, with a foot ring in a different vertical position than in FIG. 1.
Figure 4:
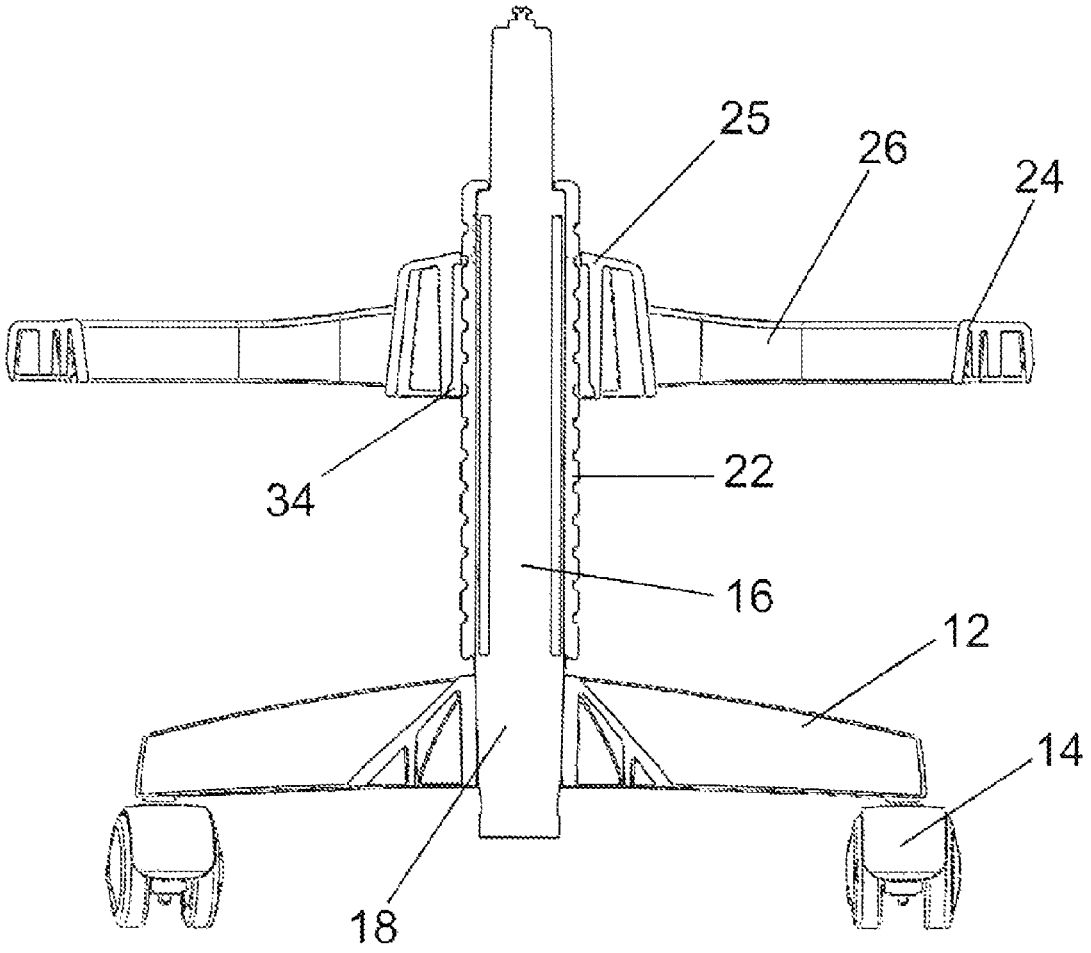
FIG. 4 is a longitudinal sectional view of the chair frame of FIG. 1.

The following will draw on FIGS. 1 to 7 in describing the invention in greater detail based on a furniture frame in the form of a chair frame for a swivel chair having a foot ring. The invention is however just as applicable for other chair and table furniture.

A chair frame 10 has a leg in the form of a star base 12 having a plurality of castors 14 and a pneumatic spring fitted on the star base 12 being a height-adjustable support column 16. By a non-illustrated seat support, a seat with a backrest can for example be rotatably mounted on the support column 16.

The support column 16 has a substantially vertically extending longitudinal axis 17 and is centrically mounted on the star base 12. The pneumatic spring forming the support column 16 contains a fixed cylinder and a piston rod coaxially accommodated therein. The piston rod is axially displaceable hydropneumatically relative to the cylinder so as to vary a length of the support column 16 and thus the height of the seat.

A first cone 18 is provided at a lower end of the pneumatic spring; i.e. the end facing the star base 12, which is received in a corresponding recess in the star base 12. The first cone 18 is preferably press-fit into the star base 12 and optionally additionally glued. In an alternative embodiment, the cylinder of the pneumatic spring, a support column of fixed length respectively, can be fit into the star base 12 in a height-adjustable manner.

A second cone 20 is provided at an upper end of the pneumatic spring; i.e. the end facing away from the piston rod. Together with a threaded pin 21 or the like, the second cone 20 serves the assembly of the seat support for the seat at the upper end of the pneumatic spring's piston rod.

A foot ring 24 having a plurality of struts or spokes 26 is affixed to the support column 16, particularly on its fixed part (e.g. cylinder of the pneumatic spring) by a fastening device. The fastening device is thereby configured such that the foot ring 24 can be mounted in vertically adjustable manner in the area of the fixed part of the support column 16. The vertical adjustment of the foot ring 24 thereby takes place independently of a vertical adjustment of the seat by adjusting the length of the support column 16. The user can thus optimally adapt the swivel chair to his/her needs, which thereby increases the user's comfort.

The fastening device contains a first threaded bushing 22 made of plastic and having an external thread 28. The external thread is preferentially configured as a double-start trapezoidal thread. The first threaded bushing 22 is pushed onto the support column 16 while still warm, for example subsequent its forming, and then further contracts to the outer circumference of the support column 16 during cooling so as to be non-rotatably connected to same. Additional fixing can be achieved for example by knurling the support column 16 and/or welding steel plates for anti-rotation and/or by an adhesive bond.

The first threaded bushing 22 additionally exhibits a first longitudinal groove 30 on its exterior extending substantially vertically and repeatedly crossing the thread groove of the external thread 28. The first longitudinal groove 30 is thereby spaced at a distance from the lower and from the upper end of the first threaded bushing 22 so as to form a first limit stop 30*a* and a second limit stop 30*b*.

A plurality of recesses 31 are preferably additionally formed in the first longitudinal groove 30. These recesses 31 are arranged spaced apart and one after the other in an axial direction. The recesses 31 are thereby each positioned within the progression of the (conjectured) thread groove of the external thread 28 through the first longitudinal groove 30, in the embodiment shown only at every second crossing.

Figure 5A:
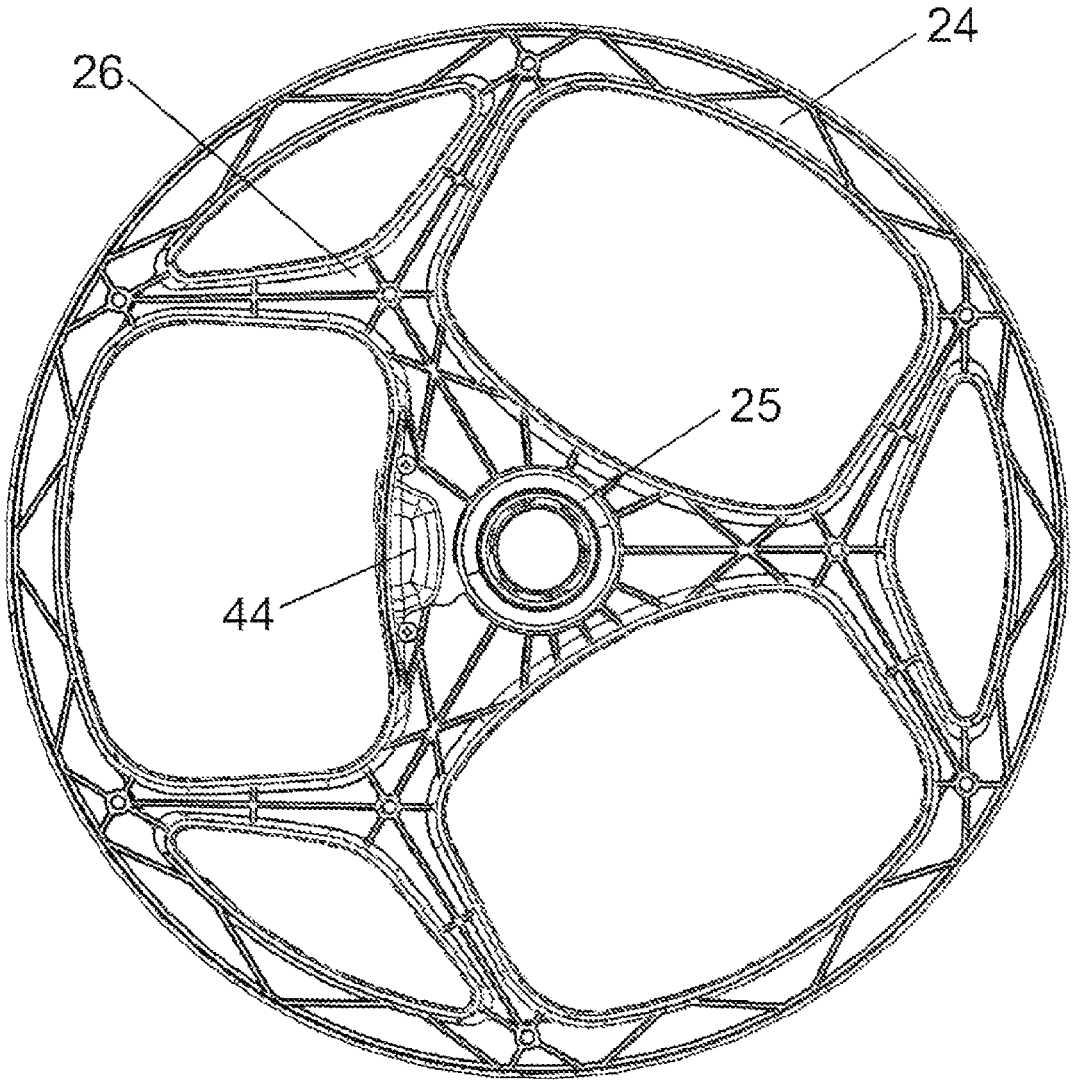
FIG. 5A is a bottom plan view of the foot ring of FIG. 1 with a fitted cover for a locking system.
Figure 5B:
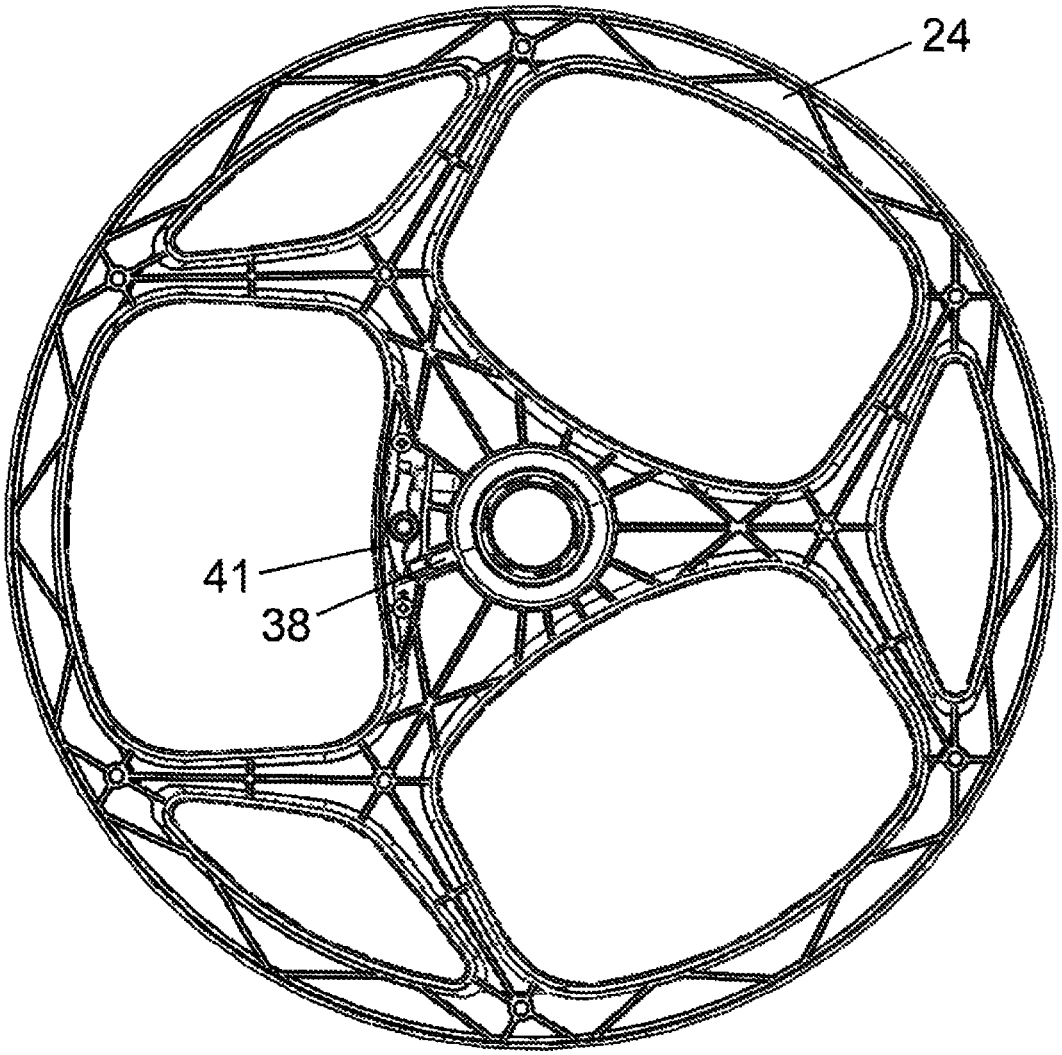
FIG. 5B is a cross-sectional view of the chair frame, shown in FIG. 1, in a height-adjustable position.
Figure 5C:
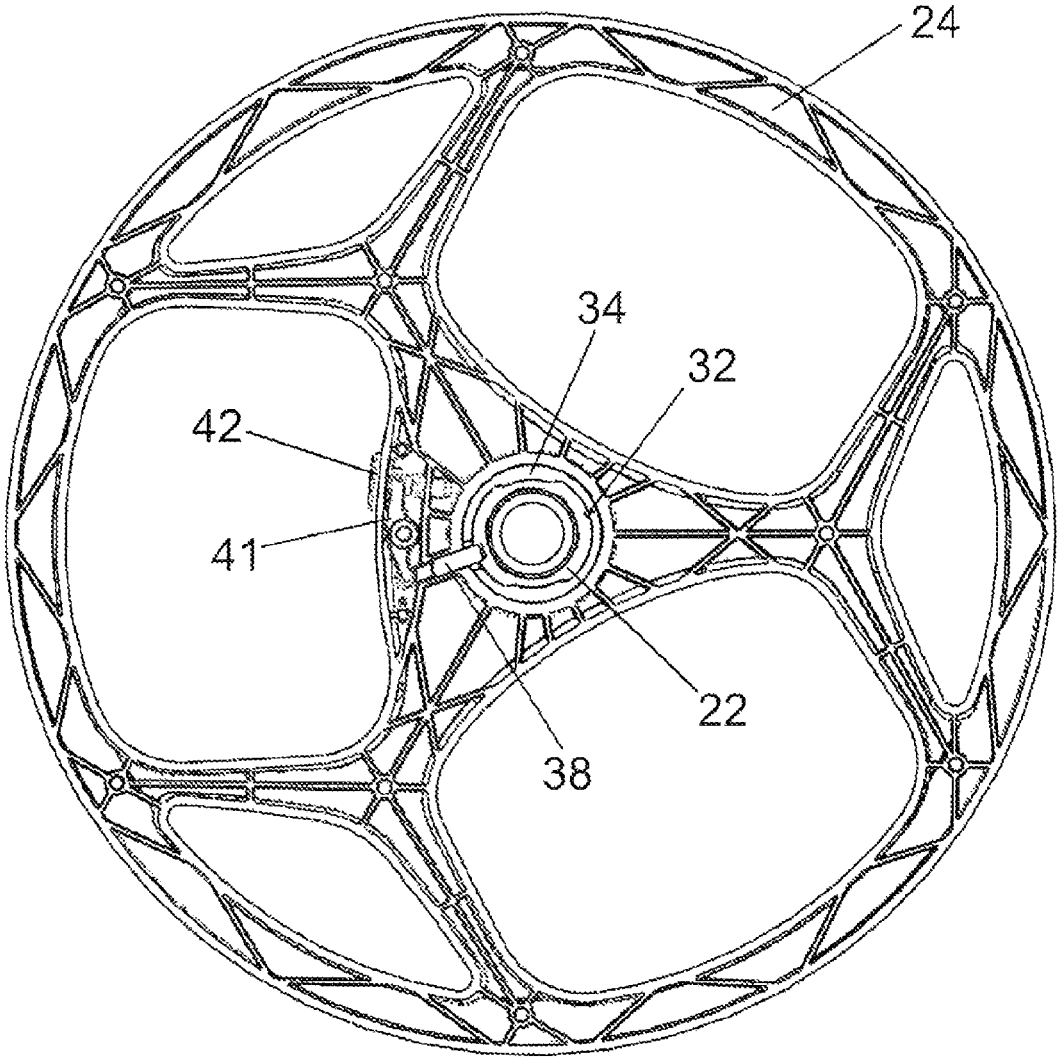
FIG. 5C is a cross-sectional view of the chair frame, shown in FIG. 1, in a fixed height position.

As shown in FIG. 5C, the first threaded bushing 22 additionally has a second longitudinal groove 32 on its exterior. The second longitudinal groove 32 is disposed substantially diametrically opposite to the first longitudinal groove 30. In addition, the second longitudinal groove 32 is of narrower dimension in the circumferential direction of the first threaded bushing 22 than the first longitudinal groove 30.

The fastening device for mounting the foot ring 24 further contains a second threaded bushing 34 made of plastic. It is accommodated in a central hub 25 of the foot ring 24 so as to be non-rotatable relative to same. For example, at least one radially outwardly protruding latch 35 is provided on the surface area of the second threaded bushing 34 which can engage or snap into a corresponding notch 27 in the foot ring 24 and/or the hub 25 of the foot ring 24, as illustrated in FIG. 6C.

The second threaded bushing 34 is thus arranged coaxially with the first threaded bushing 22 and the support column 16 and completely encloses the first threaded bushing 22. However, the second threaded bushing 34 is of considerably shorter axial design than the first threaded bushing 22. As FIG. 7 shows, the second threaded bushing 34 can for example be assembled from two half shells in order to facilitate the assembly of the chair frame 10 or its fastening device for the foot ring 24 respectively.

It is also alternatively conceivable for an internal thread 36 to be formed directly on the hub 25 of the foot ring 24; i.e. the second threaded bushing 34 to be integrally formed with the foot ring 24.

The second threaded bushing 34 exhibits an internal thread 36 on its interior which engages with the external thread 28 of the first threaded bushing 28. By so doing, the second threaded bushing 34 can rotate about the longitudinal axis 17 of the support column 16 relative to the first threaded bushing 22. The rotational movement axially displaces the second threaded bushing 34 (and thus also the foot ring 24) relative to the first threaded bushing 22 (and thus also to the support column 16).

Figure 6A:
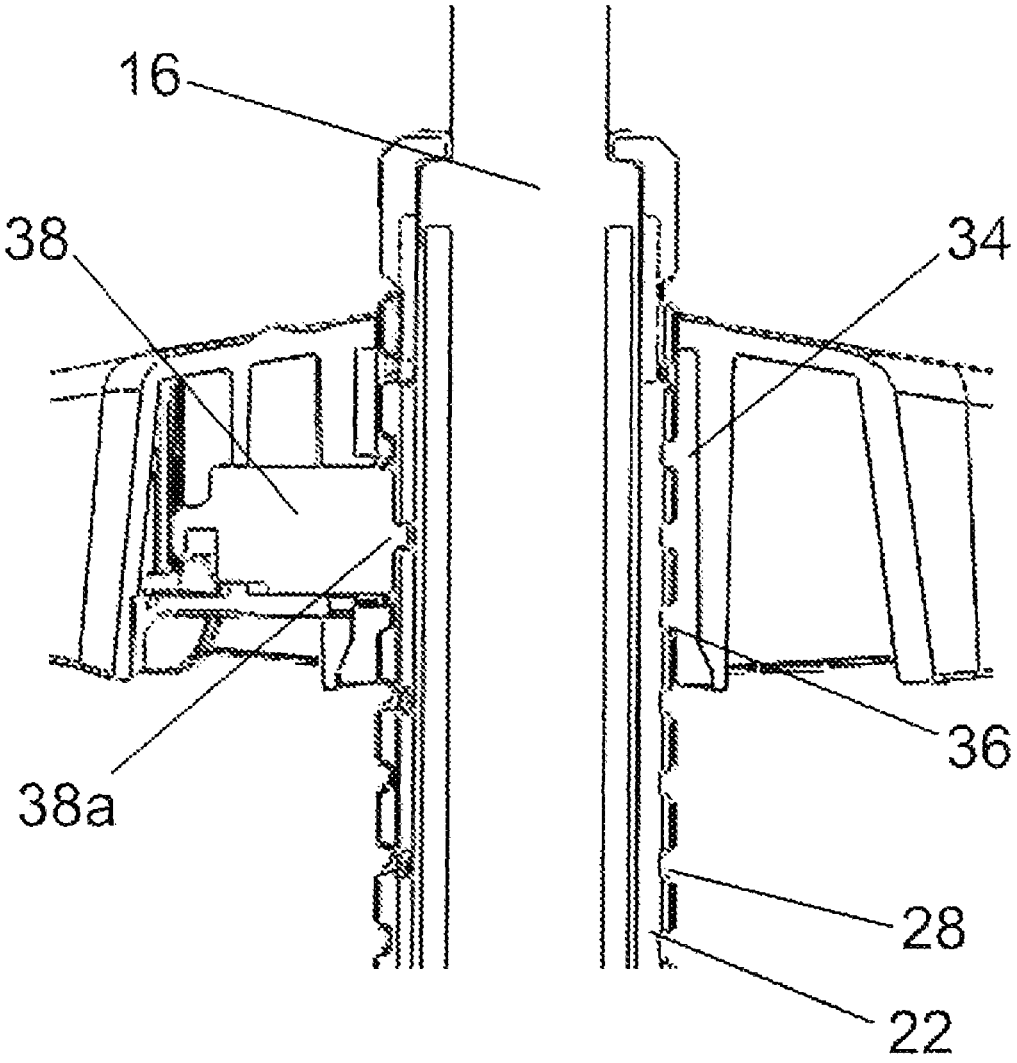
FIG. 6A is a partial longitudinal sectional view of chair frame, shown in FIG. 1, in the fixed height position of FIGS. 5C and D.
Figure 6B:
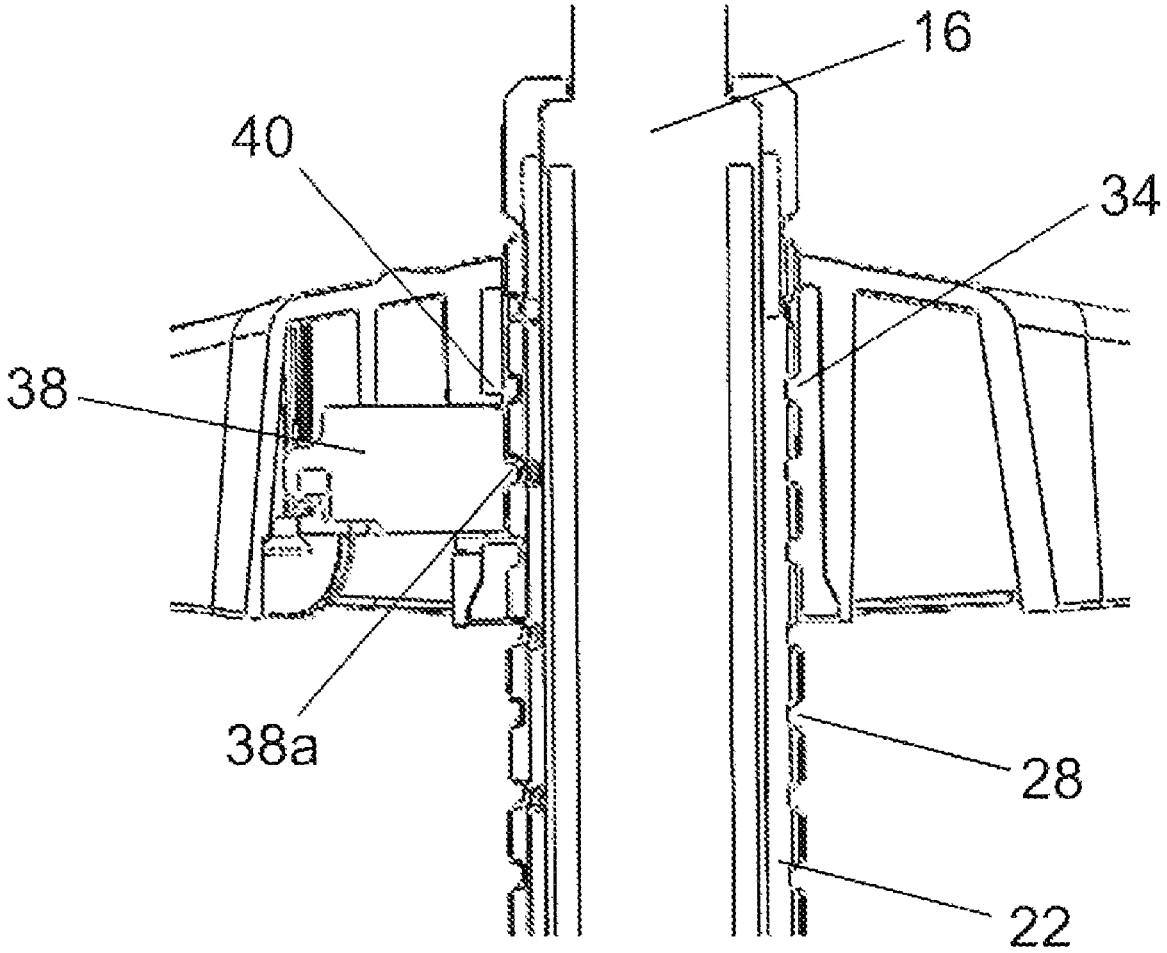
FIG. 6B is a partial longitudinal sectional view of the chair frame, shown in FIG. 1, in the height-adjustable position of FIG. 5B.
Figure 6C:
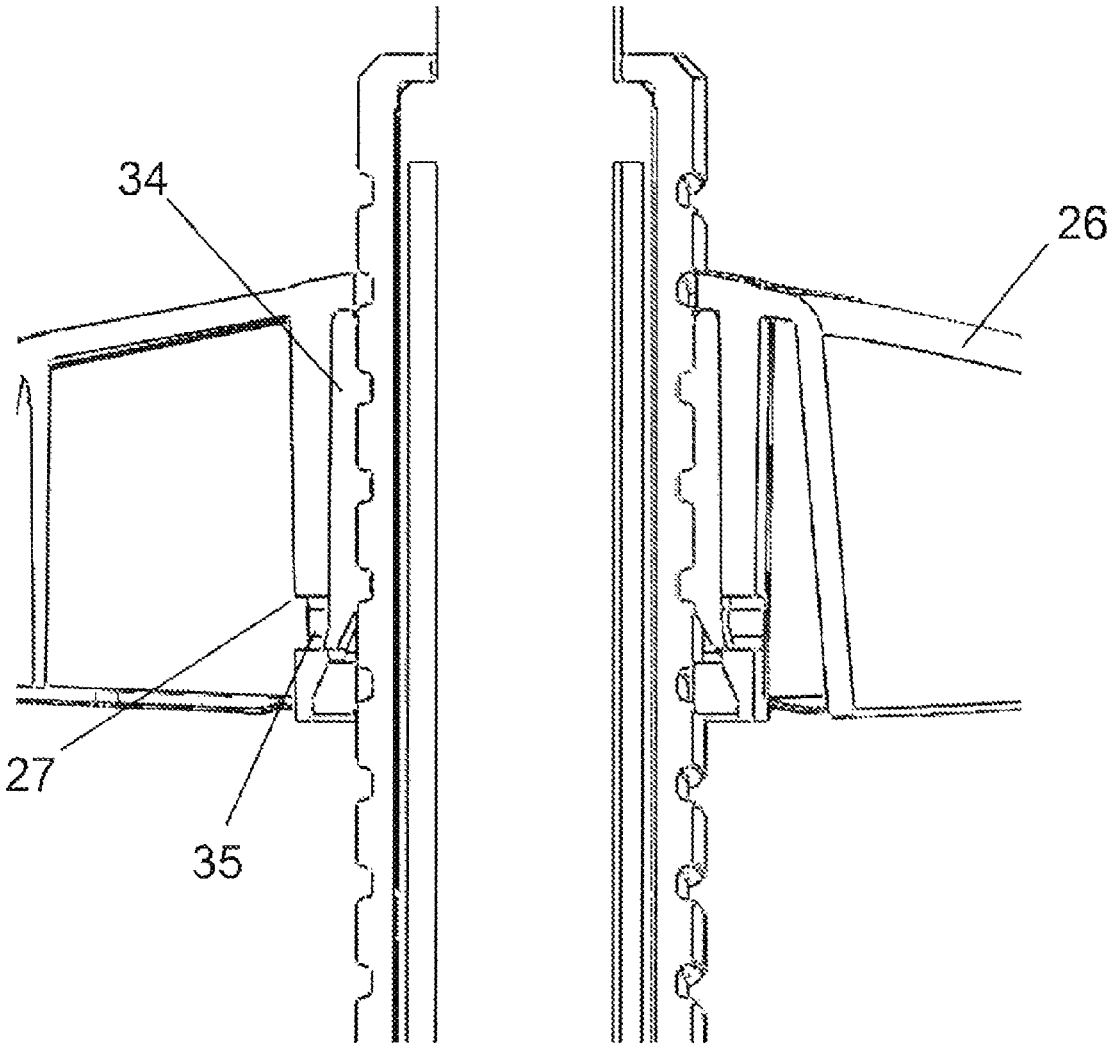
FIG. 6C is a partial longitudinal sectional view of the chair frame illustrating a non-rotatable connection between the foot ring and a second threaded bushing.
Figure 7:
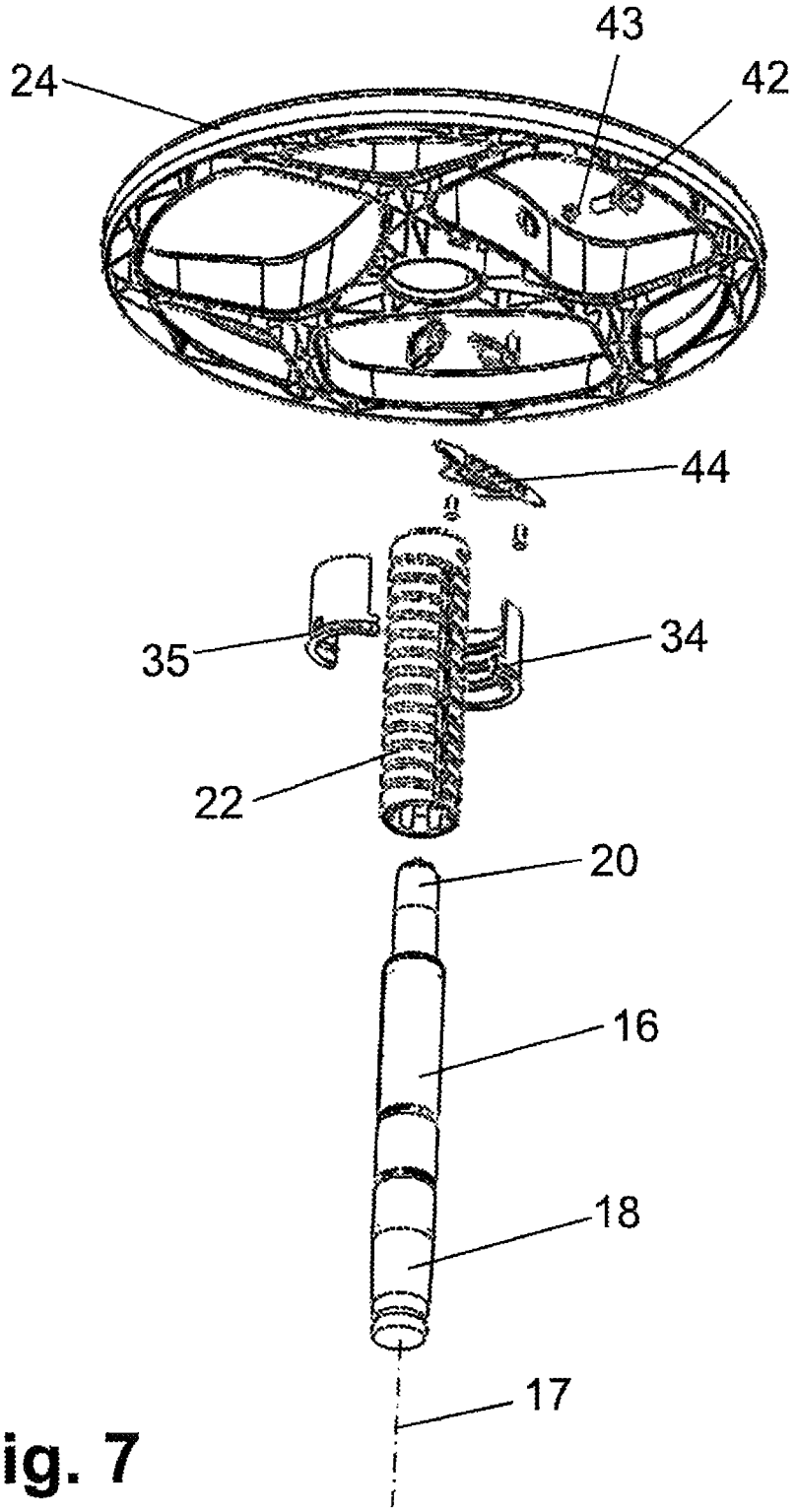
FIG. 7 is a perspective exploded view of the chair frame, shown in FIG. 1, without the star base.

In order to fix the foot ring 24 at a desired height position and be able to prevent an unintentional displacement of the foot ring 24, the fastening device additionally contains a locking element 38 (see FIGS. 5 to 7).

Figure 5D:
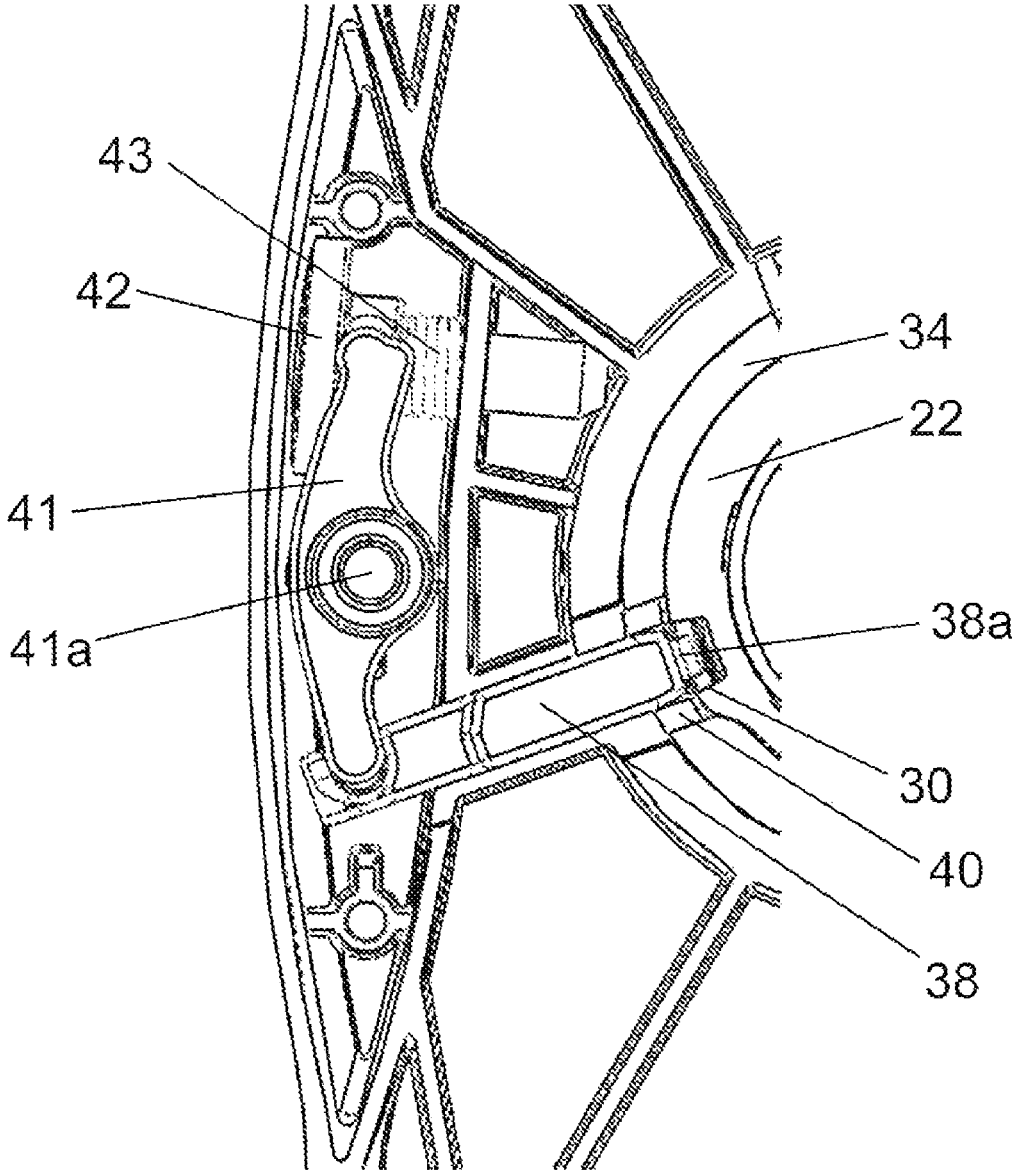
FIG. 5D is a cross-sectional, detailed view of FIG. 5C to illustrate the locking system.

The locking element 38 is made of high-strength plastic or metal and is configured substantially as a type of clamping block (alternatively: contains a guide pin and a clamping block) and contains a mandrel 38*a* (see FIGS. 5D, 6A and 6B). In the depicted embodiment, the locking element 38 is of integral configuration. The mandrel 38*a* of the locking element 38 is dimensioned such that it can engage into both the thread groove of the external thread 28 of the first threaded bushing 22 as well as the recesses 31 in the first longitudinal groove 30 of the first threaded bushing 22. The clamping block-like locking element 38 is dimensioned in the circumferential direction of the first threaded bushing 22 such that it can engage (with as little play as possible) into the first longitudinal groove 30 of the first threaded bushing 22 but not, however, the second longitudinal groove 32 of the first threaded bushing 22. In order to facilitate the engagement, the clamping block can be of slightly conical configuration. The clamping block-like locking element 38 axially extends over at least one pitch of the external thread 28 of the first threaded bushing 22.

The locking element 38 is received in a notch 40 of the second threaded bushing 34 such that it can radially move between a first operating position (FIGS. 5C, 5D and 6A) and a second operating position (FIGS. 5B and 6B). Axially and circumferentially, however, the locking element 38 is stationarily fixed in position relative to the second threaded bushing 34.

In the first operating position of the locking element 38, its clamping block form engages into the first longitudinal groove 30 of the first threaded bushing 22 and engages the mandrel 38*a* in one of the recesses 31 in the first longitudinal groove 30 of the first threaded bushing 22 so as to block relative movement between the first threaded bushing 22 and the second threaded bushing 34. In the second operating position of the locking element 38, the locking element 38 is pulled radially outward so that it rests outside on the external thread 28 of the first threaded bushing 22 and its mandrel 38*a* only engages in the thread groove of the external thread 28 of the first threaded bushing 22 so that a relative rotation is possible between the first threaded bushing 22 and the second threaded bushing 34.

The user can affect the movement of the locking element 38 between the two operating positions via an appropriate actuating element 42 (see in particular FIG. 5D) operatively connected to the locking element 38 by a lever 41 which is pivotable about a rotational axis 41*a* oriented parallel to the longitudinal axis 17 of the support column 16. To preload the locking element 38 in its first operating position, the actuating element 42 is coupled with a spring element 43. In addition, the actuating element 42 is accommodated together with the lever 41 and the spring element 43 in the foot ring 24 (alternatively: in a retaining element 44 formed on or affixed to the foot ring) and protected by a removable cover 44.

When assembling the chair frame 10, the first threaded bushing 22 is first shrink-fit onto the support column 16, then the second threaded bushing 34 is assembled around the first threaded bushing 22 on the support column 16 (see FIG. 7) and then inserted into and locked in position in the hub 25 of the foot ring 24 (see FIG. 6C). The locking element 38, the actuating element 42 with the spring element 43 and the lever 41 are thereafter inserted into the foot ring 24 and the cavity of the foot ring 24 accommodating these elements closed by a cover 44 (see FIGS. 5A and 7).

Alternatively, the second threaded bushing 34 can also be first inserted into the hub 25 of the foot ring 24 (pressed and/or glued if need be), then the locking element 38 inserted into the notch 40 of the second threaded bushing 34 from the inside and pushed outward where it can ultimately be connected to the actuating element 42 by the lever 41 prior to the foot ring 24 being closed with the cover 44. In this case, the first threaded bushing 22 is first shrink-fit onto the support column 16. The support column 16 can then be screwed with the first threaded bushing 22 into the second threaded bushing 34. Lastly, the support column 16 with the first cone 18 is set into the star base 12.

The functioning of the chair frame 10 constructed in the above-described manner is as follows.

In a non-operative state, the foot ring 24 is positioned at any given vertical position on the support column 16 of the chair frame 10 and the locking element 38 of the fastening device is preloaded in its second operating position. In this state, the foot ring 24 can neither be axially displaced, which is prevented by the engaging threads 28, 36 of the two threaded bushings 22, 34, nor rotated about the support column 16, which is prevented by the locking element 38 engaging into the first longitudinal groove 30 of the first threaded bushing 22. The fixation of the foot ring 24 in this state is further reinforced by the mandrel 38*a* of the locking element 30 engaging in one of the recesses 31 in the first longitudinal groove 30.

Should a user wish to change the vertical position of the foot ring 24 to adapt it for example to his/her own body height, the user pushes on the actuating element 42 in the foot ring 24 in order to pull the locking element 38 radially outwardly via the lever 41 against the preload force of the spring element 43 into its second operating position. The locking element 38 thereby also draws out of the first longitudinal groove 30 of the first threaded bushing 22.

The second threaded bushing 34 can then rotate relative to the first threaded bushing 22, whereby the mandrel 38*a* of the locking element 38 engages into the thread groove of the external thread 28 of the first threaded bushing 22 (guidance). After a quick rotation of the foot ring 24 (and thus the second threaded bushing 34 about the first threaded bushing 22), the user can in principle release the actuating element 42 again, the clamping block of the locking element 38 then seats on the external thread 28 of the first threaded bushing 22 since it is rotated away with the second threaded bushing 34 from the first longitudinal groove 30 in the first threaded bushing 22.

The rotation of the foot ring 24 around the support column 16 can continue up to 360°. At that point, the locking element 38 again engages in the first longitudinal groove 30 of the first threaded bushing 22 due to the preloading by the spring element 43. In addition, the mandrel 38*a* of the locking element 38 engages into the recess 31 above or below (depending upon rotational direction) the recess of the previous vertical positioning. This process can of course be repeated over and over in order to achieve a greater vertical adjustment of the foot ring 24.

A full 360° rotation of the foot ring 24 (which corresponds to one revolution) affects for example a lift of approximately 2 to 3 cm.

Upon such a rotation of the foot ring 24 about the support column 16, the mandrel 38*a* of the locking element 38 concurrently moves abraded material in the thread groove of the external thread 28 of the first threaded bushing 22 to the second longitudinal groove 32 of the first threaded bushing 22. The material can then drop into the second longitudinal groove 32 and trickle out the bottom of the chair frame 10.

This measure counteracts excessive wear of the fastening device with its movable components.

The following is a summary list of reference numerals and the corresponding structure used in the above description of the invention:

LIST OF REFERENCE NUMERALS

10 furniture frame, chair frame
12 furniture leg, star base
14 castors
16 support column
17 longitudinal axis
18 first cone
20 second cone
21 threaded pin
22 first threaded bushing
24 foot ring
25 hub
26 strut, spoke
27 notch
28 external thread of 22
30 first longitudinal groove of 22
30*a* first limit stop of 30
30*b* second limit stop of 30
31 recess in 30
32 second longitudinal groove of 22
34 second threaded bushing
35 latch on 34
36 internal thread of 34
38 locking element, catch
38*a* mandrel
40 notch in 34
41 lever
41*a* rotational axis of 41
42 actuating element
43 spring element
44 cover

The invention claimed is:

1. A furniture frame, comprising:
a support column having a longitudinal axis;
a foot ring; and
a fastening device with which said foot ring is affixed to said support column so as to be axially displaceable, said fastening device containing:
a first threaded bushing disposed coaxially with said support column and non-rotatably connected to said support column and having an external thread, said first threaded bushing having an exterior with a first longitudinal groove formed therein;
a second threaded bushing disposed coaxially with said support column and non-rotatably connected to said foot ring and having an internal thread, wherein said internal thread of said second threaded bushing engaging with said external thread of said first threaded bushing and said second threaded bushing is rotatable about said first threaded bushing by at least one revolution such that said second threaded bushing can be axially moved relative to said first threaded bushing; and
a locking element being movable between a first operating position and a second operating position, wherein said locking element prevents relative movement between said first threaded bushing and said second threaded bushing in the first operating position and enables relative movement between said first threaded bushing and said second threaded bushing in the second operating position, said locking element engaging in said first longitudinal groove in the first operating position, and said locking element being preloaded into the first operating position.

2. The furniture frame according to claim 1, wherein said fastening device further has an actuating element which is operatively connected to said locking element so as to be able to move said locking element between the first and second operating positions.

3. The furniture frame according to claim 1, wherein said locking element is non-rotatably disposed relative to said second threaded bushing and radially movable relative to said first threaded bushing.

4. The furniture frame according to claim 1, wherein said locking element has a clamping block which engages in said first longitudinal groove of said first threaded bushing in the first operating position of said locking element.

5. The furniture frame according to claim 1, wherein said locking element contains a mandrel which engages with said external thread of said first threaded bushing in the second operating position of said locking element.

6. The furniture frame according to claim 1, wherein:
said first longitudinal groove has a plurality of axial recesses formed therein; and
said locking element has a clamping block for engaging in said first longitudinal groove of said first threaded bushing in the first operating position of said locking element, and said locking element has a mandrel engaging in one of said axial recesses in said first longitudinal groove of said first threaded bushing in the first operating position of said locking element and engages in said external thread of said first threaded bushing in the second operating position of said locking element.

7. The furniture frame according to claim 1, wherein said first longitudinal groove is spaced at a distance from an end of said first threaded bushing facing toward a furniture leg and/or from said end of said first threaded bushing facing away from the furniture leg.

8. The furniture frame according to claim 1, wherein said external thread of said first threaded bushing is configured as a trapezoidal thread.

9. The furniture frame according to claim 1, wherein said first threaded bushing has at least one second longitudinal groove formed therein with which said locking element cannot engage.

10. The furniture frame according to claim 1, wherein said support column is adjustable in a length direction.

11. The furniture frame according to claim 1, wherein the furniture frame is selected from the group consisting of a chair frame and a table frame.

12. An item of furniture, comprising:
a top selected from the group consisting of a seat top and a table top; and
a furniture frame, containing:
a support column having a longitudinal axis and supporting said top;
a foot ring; and
a fastening device with which said foot ring is affixed to said support column so as to be axially displaceable, said fastening device containing:
a first threaded bushing disposed coaxially with said support column and non-rotatably connected to said support column and having an external thread, said first threaded bushing having an exterior with a first longitudinal groove formed therein;
a second threaded bushing disposed coaxially with said support column and non-rotatably connected to said foot ring and having an internal thread, said internal thread of said second threaded bushing engaging with said external thread of said first threaded bushing and said second threaded bushing is rotatable about said first threaded bushing by at least one revolution such that said second threaded bushing can be axially moved relative to said first threaded bushing; and a locking element being movable between a first operating position and a second operating position, said locking element preventing relative movement between said first threaded bushing and said second threaded bushing in the first operating position and enabling relative movement between said first threaded bushing and said second threaded bushing in the second operating position, said locking element engaging in said first longitudinal groove in the first operating position, and said locking element is preloaded into the first operating position.

13. The item of furniture according to claim 12, wherein said locking element has a clamping block engaging said first longitudinal groove of said first threaded bushing in the first operating position of said locking element.

14. The item of furniture according to claim 12, wherein:

said first longitudinal groove has a plurality of axial recesses formed therein; and said locking element has a clamping block engaging in said first longitudinal groove of said first threaded bushing in the first operating position of said locking element, said locking element further having a mandrel engaging in one of said axial recesses in said first longitudinal groove of said first threaded bushing in the first operating position of said locking element and engages in said external thread of said first threaded bushing in the second operating position of said locking element.

* * * * *